US007066132B1

(12) United States Patent
Verbrugge et al.

(10) Patent No.: US 7,066,132 B1
(45) Date of Patent: Jun. 27, 2006

(54) PISTON WITH OXIDATION CATALYST

(75) Inventors: Mark W. Verbrugge, Troy, MI (US); Yar-Ming Wang, Troy, MI (US); Hong-Hsiang Kuo, Troy, MI (US); Hsai-Yin Lee, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/035,345

(22) Filed: Jan. 13, 2005

(51) Int. Cl.
*F02B 77/11* (2006.01)

(52) U.S. Cl. ..... 123/193.6; 123/536; 92/223; 29/888.048

(58) Field of Classification Search ..... 123/193.6, 123/536–538; 92/223; 29/888.048
See application file for complete search history.

(56) References Cited

U.S. PATENT DOCUMENTS 3,263,310 A * 8/1966 Rosen ..... 29/888.042
5,435,873 A * 7/1995 Penrice ..... 156/240
5,469,777 A * 11/1995 Rao et al. ..... 92/223
5,477,820 A * 12/1995 Rao ..... 123/193.6

* cited by examiner

*Primary Examiner*—Marguerite McMahon
(74) *Attorney, Agent, or Firm*—Kathryn A. Marra

(57) ABSTRACT

Pistons reciprocating in cylinders of a hydrocarbon-fueled internal combustion engine tend to trap air and unburned fuel between the top of the piston head and its enclosing cylinder wall. The circumferential side surface (or land) of the piston head above its upper piston ring groove is provided with a thin coating of porous aluminum oxide. Particles of an oxidation catalyst for the engine's fuel are electrolytically deposited in the pores of the oxide coating. During engine operation the oxide-supported catalyst particles promote combustion of the entrained fuel.

12 Claims, 1 Drawing Sheet

PISTON WITH OXIDATION CATALYST

TECHNICAL FIELD

This invention relates to hydrocarbon fueled internal combustion engines with reciprocating aluminum pistons in cylinder bores of the engine. More specifically, this invention pertains to the application of an oxidation catalyst on a selected portion of a piston for burning fuel trapped between the piston and cylinder bore wall.

BACKGROUND OF THE INVENTION

Automotive engineers continually strive to obtain complete combustion in hydrocarbon-fuel mixtures introduced into the combustion cylinders of reciprocating piston internal combustion engines. Engine cylinder blocks with their cylinder bores are carefully manufactured so that the bores are suitably round for receiving the pistons. Aluminum alloy pistons (for low weight and inertia) are cast or forged and machined to fit for high speed reciprocating motion in the cylinder bores. Generally, each piston has a head portion and a skirt portion. Circumferential grooves are machined near the top of each piston head to receive two compression rings and one or more oil retention rings. The respective rings are split at one point so that they can be placed around the piston head and in the grooves and then compressed inwardly when the assembly of piston and rings is fitted into a cylinder of an engine. Viewed from the working face of the piston head, the top and next lower compression rings serve to prevent hot combustion gas from blowing past the piston and into the lubrication oil containing crankcase. The bottom oil retention ring(s) scrape oil sprayed on the cylinder wall into a thin lubrication film.

Thus, the circumferential side of the piston head does not directly contact the surrounding cylinder bore. Rather, it is the piston rings that slide up and down on the lubricated cylinder wall. And there is an ever moving annular crevice between the top cylindrical land of the piston head, down to the top piston ring, and the cylinder bore. During the intake stroke of the piston, fuel can be caught in this moving crevice and subsequently not ignited when the air-fuel charge is burned. The energy content of this small portion of unburned fuel is not utilized in the power stroke of the engine. Instead the unburned fuel material is exhausted from the combustion chamber during the exhaust stroke of the piston, leading to unwanted emissions, particularly hydrocarbon emissions. Thus, there is a need for a piston head design that assures combustion of fuel trapped between the moving piston head and the cylinder wall of the engine block.

SUMMARY OF THE INVENTION

The head and skirt portions of cast or forged aluminum alloy pistons are typically machined to a specified degree of roundness for the cylinder bore in which they are to operate. The piston head is machined, if necessary, to provide at least one groove in the circumferential surface of the piston head for a compression piston ring. The groove closest to the top surface of the piston isolates a circumferential strip or land surface portion between the groove and the working top surface of the piston.

In accordance with the invention, this uppermost annular land surface is electrolytically anodized to form a surface layer of pore-containing aluminum oxide columns. By way of example, the piston head may be immersed in a suitable aqueous sulfuric acid bath electrolyte for this anodization step. The piston(s) is arranged as an anode for the electrolysis and the land surface is oxidized to form the porous aluminum oxide surface. When specified, much, or all, of the cylindrical surface of the piston head and/or skirt may be provided with a hard anodized coating for wear resistance as it reciprocates close by the surface of the engine cylinder bore in which it is contained. However, in the practice of this invention the upper land strip is anodized to form an oxide layer that is at least about two microns thick.

The anodized piston is then paced in a second electrolyte bath containing a salt of an oxidation catalyst for the hydrocarbon fuel. The piston(s) is arranged as a cathode in this bath and small metal particles of the catalyst are electrodeposited from the electrolyte solution into the pores of the aluminum oxide layer. By way of illustrative example, the oxidation catalyst containing electrolyte may contain dinitroplatinate sulfate, $H_2Pt(NO_2)_2SO_4$, dissolved in an aqueous sulfuric acid electrolyte. Upon application of a suitable current, platinum ions in the electrolyte are reduced to particles of platinum metal in the cathodic pores of the aluminum oxide coating.

Pistons containing the aluminum oxide coating with deposited oxidation catalyst particles are placed in an engine cylinder block. During operation of the engine the piston soon is heated to a temperature within its operating range. Air-fuel mixtures are sequentially drawn into the cylinder bores of the engine during an intake stroke of the piston and compressed by the piston head for ignition during the following compression stroke. Some inducted fuel may be trapped in the narrow annular space between the upper piston head land above the top piston ring and the adjoining cylinder wall of the engine block. But the trapped fuel in the moving space is much more susceptible to combustion when in contact with the hot oxidation catalyst carried in the aluminum oxide surface layer on the piston land strip. More energy is obtained from the inducted air-fuel mixture and less unburned fuel is discharged into the exhaust when the piston pushes the burned mixture past the exhaust valve.

Other objects and advantages of the invention will become more apparent from a description of preferred embodiments which follow.

DESCRIPTION OF PREFERRED EMBODIMENTS

Figure 1:
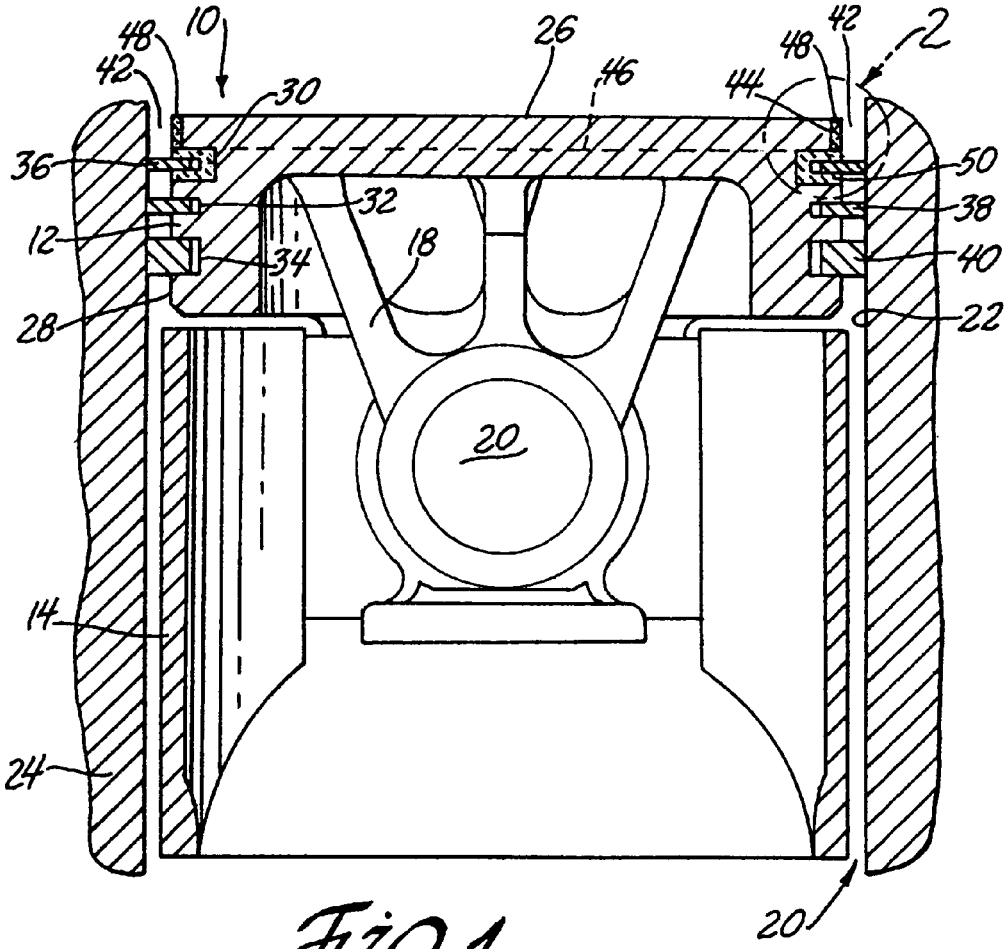
FIG. 1 is a cross-sectional view of a portion of an engine cylinder block with an enclosed piston head and skirt and showing an upper and lower compression rings and an oil ring.

FIG. 1 illustrates, in side cross-sectional view, a piston 10 which is made of aluminum for lower weight and inertia in engine operation. Pistons are often cast from a suitable silicon/aluminum eutectic or hypereutectic alloy. In some engines forged aluminum alloy pistons are specified. In accordance with the practice of this invention an aluminum alloy composition is employed which can be anodized and catalyzed as described in more detail in this specification.

Piston 10 has a head (or crown) 12 and a skirt 14. The head 12 and skirt 14 are connected through a strong weight-saving structure indicated generally at 18 that includes a transverse hole 20 for connection with a piston pin (not shown) to a connecting rod and, thus, to a crankshaft (neither shown).

Piston 10 reciprocates in a cylinder bore 20 defined by cylinder wall 22 in cylinder block 24. The practice of this invention is focused on piston head 12. Piston head 12 is illustrated with a flat upper face 26, although the upper face of many pistons is provided with domed and cupped surfaces to enhance ignition of an air/fuel charge. These features of the upper face of piston 12 do not significantly alter the practice which is focused on the cylindrical side surface 28 of piston head 12.

Piston head 12 is illustrated with three machined piston ring grooves 30, 32, and 34 proceeding from upper face 26 downwardly along cylindrical side surface 28. Piston ring groove 30 receives upper piston compression ring 36; groove 32 receives lower piston compression ring 38; and groove 34 receives oil retention ring 40.

Figure 2:
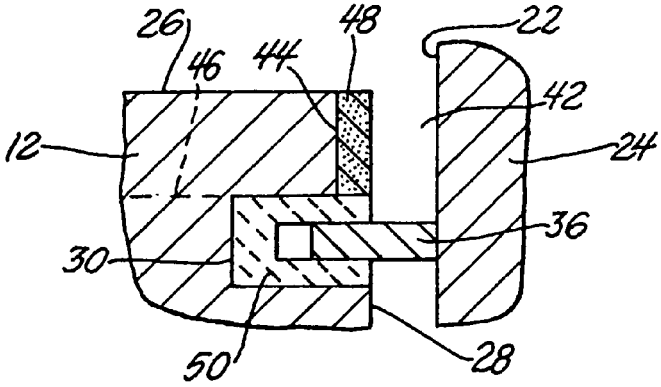
FIG. 2 is an enlarged cross-sectional view of portion 2 of FIG. 1 showing portions of the upper compression ring and the upper circumferential land portion of the piston head which has an oxidation catalyst particle filled porous anodized surface layer.

FIG. 2 is an enlarged cross-sectional view of the portion of piston head 12 and cylinder block 24 enclosed in circle 2 indicated on FIG. 1. Both FIGS. 1 and 2 show a ring-shaped crevice 42 between the upper surface of upper piston compression ring 36, cylinder wall 22, and upper land surface 44 portion of piston cylindrical side surface 28. In the operation of a hydrocarbon-fueled, reciprocating piston, internal combustion engine, ring-shaped crevice 42 is a moving volume as piston 10 reciprocates in cylinder bore 20. Despite the rapid movement of crevice 42, fuel caught in that volume may not be burned when the main air/fuel charge above piston face 26 is ignited during the compression stroke of piston 10. In accordance with this invention, land surface 44 of piston 10 is provided with an oxidation catalyst suitable for the fuel composition consumed in the engine. At the operating temperature of the engine the catalytic surface at crevice 42 facilitates burning of fuel contained in that volume.

Upper land surface 44 is a ring-like band extending around the circumference of piston head 12 between piston head top surface 26 and the upper edge of piston ring groove 30 indicated by dashed line 46.

An anodized aluminum oxide containing coating is electrolytically formed on upper piston head land surface 44. The layer is characterized by columns of aluminum oxide with pores or cavities in and between them. This aluminum oxide layer 48 is illustrated schematically and enlarged in FIGS. 1 and 2.

Such electrolytically formed aluminum oxide layers have previously been formed on the side cylindrical (circumferential) surfaces of piston head 12 (i.e., surface 28) and piston skirt 14 to increase hardness and wear resistance. The coating practice for such wear resistant layers is termed "hard anodizing." A dense layer of columnar aluminum oxide is formed electrolytically to a thickness of up to ten to twenty micrometers. Such hard anodized coatings may also be formed on the sides of the piston head ring grooves to reduce the wear of a piston ring moving and flexing in the groove. Such an anodized layer 50 is illustrated on the sides and bottom of upper compression ring groove 30 in FIGS. 1 and 2.

But the function of aluminum oxide layer 48 on the piston head land surface 44 is not to provide wear resistance. The purpose of porous aluminum oxide layer 48 is to carry particles of an oxidation catalyst for oxidation of fuel entrained in crevice 42. That is the reason that aluminum oxide layer 48 is illustrated as speckled with black dots. Layer 48 does not have to be as thick as a hard anodized aluminum oxide layer intended for resistance to hard sliding wear. Aluminum oxide layer 48 is at least about two micrometers thick and preferably about five micrometers thick.

In preparation for anodizing, aluminum alloy pistons are cleaned, for example, in trisodium phosphate for five minutes at 60° C. and rinsed in water. The surfaces of the piston head and piston skirt may be masked depending upon which areas are to be provided with an aluminum oxide coating. In this case, of course, piston head land surfaces 44 are prepared for electrolytic anodizing. The cleaned piston surfaces are etched in sodium hydroxide solution for five minutes at 60° C. and rinsed and then de-smutted (deoxidized) in nitric acid solution for one minute with a water rinse.

The piston head land surfaces 44 are suitably anodized in aqueous sulfuric acid electrolyte under conditions to produce anodized coatings that are at least two micrometers and suitably up to about twenty micrometers in thickness. Sulfuric acid electrolytes are preferred over other acid electrolytes to minimize corrosive residues on the anodized pistons. The electrolyte bath suitably contains about 165 grams of sulfuric acid per liter of bath. The aluminum alloy piston workpieces were arranged as anodes in the bath with, for example, stainless steel cathode bars. The anodization is suitably conducted at a temperature of about 25° C. and 16 volts; direct current is passed for several minutes until the desired anodized thickness is obtained. For example, a thickness of the order of ten to fifteen micrometers is suitable. A current density of about 12–15 amperes per square foot is suitable. Following anodization, the samples are rinsed in deionized water. Thus, each piston head land 44 is provided with a layer 48 of a dense porous coating of columnar aluminum oxide. (Note: in the fully processed piston, layer 48 includes the aluminum oxide coating with catalyst particles deposited in its pores.) These anodized coatings, about two to twenty micrometers thick, are now to receive an electrolytic deposition of oxidation catalyst metal particles in the pores.

The pistons are now processed in a new electrolyte with a platinum salt species from which platinum metal oxidizing catalyst particles can be deposited in the aluminum oxide coating 48 on piston head land surface 44. Pistons with anodized land surfaces 44 are now arranged as cathodes in an electrolytic cell for Pt deposition. A non-chloride containing platinum salt, such as $H_2Pt(NO_2)_2SO_4$ (5 grams of platinum as dinitroplatinite sulfate per liter of electrolyte) in a sulfuric acid solution (pH 2) is suitable. This salt is particularly appropriate in that sulfuric acid is the most common electrolyte employed in anodizing processes, so elaborate cleaning procedure are not needed in going from the anodizing step to the catalyzing step. A platinum salt with a sulfate anion is preferred.

An alternating current electrical potential is applied to the piston cathodes with a platinum-niobium alloy mesh counter-electrode (anode) in the aqueous platinum ion containing, sulfuric acid based electrolyte at room temperature. Platinum particles are deposited in the pores of the thin (on the order of at least two microns thick and preferably at least five microns thick) $Al_2O_3$ layer 48. Typical platinum deposition voltages are in the range of about 5–10 V AC. The amount of platinum deposition can be determined using color measurement instrumentation as employed in evaluation of the coloring of anodized coatings with tin and other metals. Typically the platinum first deposits in the bottom of the pores. The amount of platinum can be controlled by deposition time to achieve a desired fuel oxidation performance on a particular piston. Thus, in the finished pistons, layer 48 comprises porous aluminum oxide columns carrying and protecting particles of an oxidation catalyst suitable for the fuel used in engine operation.

During engine operation each piston is heated and the oxidation catalyst particles in the anodized and catalytic layer 48 promote full oxidation of air-containing fuel mixtures occupying crevice 42.

The practice of the invention has been illustrated using platinum as the oxidation catalyst for gasoline or diesel fuel. However, other metals (such as other noble metals) having fuel oxidizing properties may also be used, alone or in combinations. Preferably, a water soluble salt of the metal is selected for electrolytic reduction of the metal cations in the pores of the aluminum oxide-containing surface layer The scope of the invention is not limited to the illustrated practices.

The invention claimed is:

1. An aluminum alloy piston for reciprocation in a cylinder bore of a hydrocarbon-fueled internal combustion engine, the piston comprising:

a piston head with a top surface and a circumferential side surface between the top surface and a piston ring groove spaced from the top surface;

the circumferential side surface comprising a porous coating of aluminum oxide and particles of an oxidation catalyst for the fuel within the pores of the aluminum oxide coating.

2. An aluminum alloy piston as recited in claim 1 in which the coating of aluminum oxide is at least about two microns thick.

3. An aluminum alloy piston as recited in claim 1 in which the oxidation catalyst is a noble metal.

4. An aluminum alloy piston as recited in claim 1 in which the oxidation catalyst is platinum.

5. An aluminum alloy piston as recited in claim 1 in which the aluminum oxide coating was formed by electrolytic anodization.

6. An aluminum alloy piston as recited in claim 1 in which the porous coating of aluminum oxide was formed by electrolytic deposition and the particles of oxidation catalyst were deposited in the porous coating of aluminum oxide by subsequent electrolytic deposition.

7. A method of making an aluminum alloy piston for reciprocation in a cylinder bore of a cylinder block of a hydrocarbon-fueled internal combustion engine, the piston comprising a piston head with a top surface and a circumferential side surface between the top surface and a piston ring groove spaced from the top surface; the method comprising:

electrolytically forming a layer of porous aluminum oxide on the circumferential land surface portion; and then electrolytically depositing particles of an oxidation catalyst in the pores of the aluminum oxide layer.

8. A method of making an aluminum alloy piston as recited in claim 7 comprising forming the layer of porous aluminum oxide while immersing the piston as an anode in an aqueous electrolyte bath.

9. A method of making an aluminum alloy piston as recited in claim 7 comprising forming the layer of porous aluminum oxide while immersing the piston as an anode in an aqueous electrolyte bath containing sulfuric acid.

10. A method of making an aluminum alloy piston as recited in claim 7 comprising depositing particles of an oxidation catalyst in the pores of the aluminum oxide layer by immersing the piston as a cathode in an electrolyte of catalyst cations and depositing the catalyst particles in the pores of the aluminum oxide by electrolytic reduction of the catalyst cations.

11. A method of making an aluminum alloy piston as recited in claim 7 comprising depositing particles of an oxidation catalyst in the pores of the aluminum oxide layer by immersing the piston as a cathode in a sulfuric acid containing electrolyte of catalyst cations and depositing the catalyst particles in the pores of the aluminum oxide by reduction of the cations.

12. A method of making an aluminum alloy piston as recited in claim 7 comprising depositing particles of platinum in the pores of the aluminum oxide layer by immersing the piston as a cathode in a sulfuric acid containing electrolyte of platinum cations and depositing platinum particles in the pores of the aluminum oxide by electrolytic reduction of platinum cations.

* * * * *